US005594959A

United States Patent [19]

Nichols-Roy et al.

[11] Patent Number: 5,594,959

[45] Date of Patent: Jan. 21, 1997

[54] DUAL-FLUSH REFILL APPARATUS

[75] Inventors: David Nichols-Roy; Dennis D. Woods, both of Escondido, Calif.

[73] Assignee: Hunter Plumbing Products, San Marcos, Calif.

[21] Appl. No.: 476,422

[22] Filed: Jun. 7, 1995

Related U.S. Application Data

[63] Continuation-in-part of Ser. No. 230,088, Apr. 20, 1994, Pat. No. 5,452,482.

[51] Int. Cl.[6] ..... F16K 31/18

[52] U.S. Cl. ..... 4/415; 137/441

[58] Field of Search ..... 4/353, 366, 415, 4/324, 325; 137/441

[56] References Cited

U.S. PATENT DOCUMENTS

| | | | |
|---|---|---|---|
| 1,794,640 | 3/1931 | Owens | 4/366 |
| 2,183,677 | 12/1939 | Heath | 4/415 X |
| 3,716,870 | 2/1973 | Ducey | 4/366 |
| 4,240,168 | 12/1980 | Duke | 4/326 |
| 4,497,076 | 2/1985 | Sullivan | 4/353 X |
| 5,341,520 | 8/1994 | Lazar | 4/325 |

FOREIGN PATENT DOCUMENTS

| | | | |
|---|---|---|---|
| 0287501 | 12/1952 | Switzerland | 4/366 |

*Primary Examiner*—Robert M. Fetsuga

*Attorney, Agent, or Firm*—Baker, Maxham, Jester & Meador

[57] ABSTRACT

A refill apparatus for a dual flush apparatus comprises a refill tube connected to a refill valve responsive to a drop in water level in a tank to initiate a refill flow of water for refilling the tank and for refilling a trap via an overflow tube, the refill tube having an inlet end connected to the valve and an outlet end positioned for directing water to the overflow tube for refilling the trap, and a diverting member for diverting the refill flow from the refill tube to the tank during a portion of the refill following a long flush.

12 Claims, 4 Drawing Sheets

DUAL-FLUSH REFILL APPARATUS

REFERENCE TO RELATED APPLICATIONS

The present application is a continuation-in-part of application Ser. No. 08/230,088, filed Apr. 20, 1994, U.S. Pat. No. 5,452,482.

BACKGROUND OF THE INVENTION

The present invention relates to dual flush systems used in gravity flush toilets and pertains particularly to an improved trap refill apparatus.

A conventional toilet consists of a bowl, normally containing a volume of water into which is deposited human waste products. The waste products are flushed from the bowl by means of water from a tank or reservoir by means of a flushing apparatus. The flushing apparatus comprises a flapper valve that is raised from its seat to release a predetermined amount of water from the reservoir.

Until recent years the conventional toilet used from 5–8 gallons of water per flush. Water shortages throughout the major portions of the United States has forced major improvements in the toilet, such that as little as 1.6 gallons of water is utilized for a standard flush for solid waste removal.

Even further improvements have led to a dual flushing system, wherein a short flush is utilized to flush liquid wastes, and a long flush is utilized to flush solid wastes. The water is dispensed to the toilet bowl by way of a flush valve and seat, such as a flapper which allows the user to flush most of the tank water for a long flush, or just a portion of the tank water on the short flush. Once the toilet has been flushed, the tank is refilled automatically by a refill valve assembly connected to a water supply.

The refill assembly comprises a float operated valve which functions to open the valve and allow the entry of water when the water level drops below a certain level. The refill mechanism includes means for directing approximately 20–30% of the water into an overflow tube which goes to refill the bowl and the remainder of the water into the tank to refill it. The water is divided so that as soon as the tank has been refilled to the shut-off position, the bowl has been similarly filled so that the trap is sealed.

The drawback of the dual flush systems is that they do not account for the fact that successive short flushes typically will result in a bowl having less and less water, eventually not sealing the p-trap adequately. This frequently results in poor flush performance. It also results in wasting water by requiring double flushing to completely remove bowl contents when the trap is not full at the start of the flush cycle.

Some dual flush systems have overcome this by requiring the fill valve to have a higher than standard refill rate during refill. However, this results in wasted water. When a refill occurs after a long flush, the bowl and trap will be filled before the tank is filled and the water will continue to flow down the drain. The refill valve delivers significantly more bowl refill water on the long flush cycle compared to the short flush cycle. If the trap is adequately filled on the short flush cycle, then the additional bowl refill water will overfill the trap and spill over the weir into the drain on the long flush.

Accordingly, it is desirable that a refill apparatus be available which compensates for both long flushes and short flushes of a toilet.

SUMMARY OF THE INVENTION

It is the primary object of the present invention to provide an improved refill apparatus for effectively accommodating both long flushes and short flushes of a toilet.

In accordance with a primary aspect of the present invention, a refill apparatus includes means responsive to water level within a flush tank to selectively divert refill water from the overflow tube during refill of the system.

BRIEF DESCRIPTION OF THE PREFERRED EMBODIMENTS

The above and other objects and advantages of the present invention will be apparent from the following description when read in conjunction with the accompanying drawings wherein:

FIG. 1 is a perspective view of a refill apparatus in accordance with a preferred embodiment of the invention;

FIG. 2*a* is an elevation view in the embodiment of FIG. 1 showing one position of operation;

FIG. 2*b* is a partial view like FIG. 2*a* showing another position of operation;

DETAILED DESCRIPTION OF THE PREFERRED EMBODIMENTS

Figure 1:
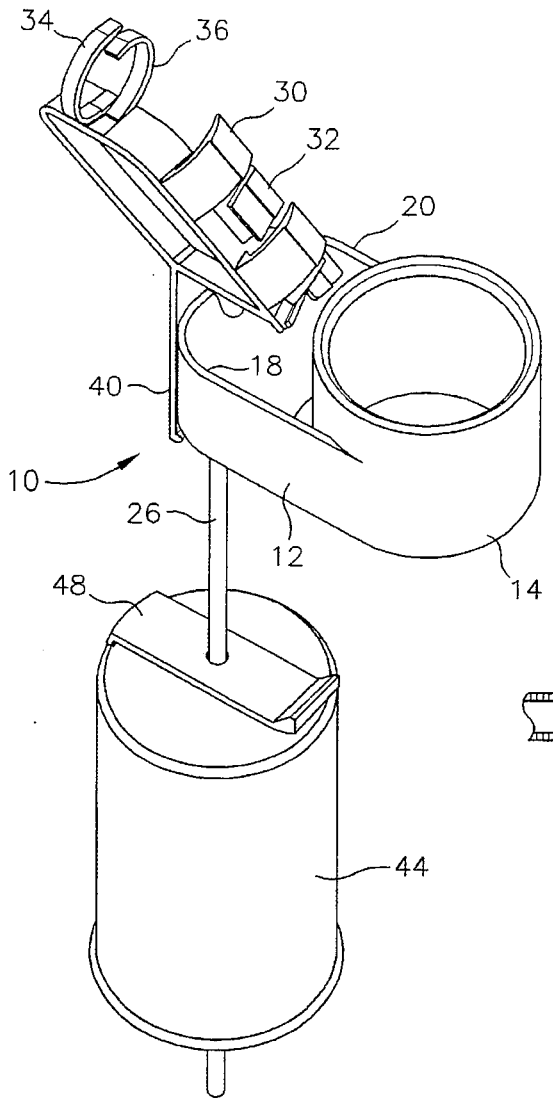

Referring to the drawings, particularly FIG. 1, there is illustrated a refill control apparatus in accordance with the preferred embodiment of the invention designated generally by the numeral 10. This apparatus comprises a bracket 12 having a sleeve or clamp portion 14 for mounting on an upper end of an overflow tube 15, sometimes referred to as a standpipe, within a flush tank of a toilet. The sleeve 14 may be of a fixed diameter for specific flush systems or may be an adjustable clamp-like device to fit different size systems. The bracket, as illustrated, includes a lip 16 for engaging the upper end of an overflow tube to position and hold the bracket in place.

A pair of arms 18 and 20 extend out from one side of the sleeve 14 and form a connected loop in which is formed a bore 22 for reciprocally receiving a movable mounting structure. A moveable tube support means comprises a main body 24 having an elongated shaft 26 for reciprocally mounting within the bore 22. The shaft 26 extends vertically downward from a bottom or lower end of the body 24. A plurality of hose or tube clamps extend upward from the top of the body 24 for receiving refill hose 25 and comprises opposing C-shaped members 28 and 30 extending in one direction and an opposing clamp member 32 extending in the opposite direction. A pair of opposed clamp members 34 and 36 are positioned at the outer end of the support body 24.

A tube or hose stop member 38 is positioned to be engaged by the end of the refill tube to maintain its position. A clip member 40 having a stop shoulder 42 extends over the outside of the bracket portion 22 for limiting the upward vertical movement of the support member 24.

The shaft 26 may include an extension which may be either integral therewith or a separate member on which is mounted a float 44. The float as illustrated is in the form of an inverted container having a central through bore 46 through which the shaft 26 extends and latch or grip member 48 for latching the float to selected positions along the length of the shaft 26. This is effective to position the float for proper response to selected levels of water for thereby selectively positioning the outlet end of the refill tube to a selected diverting position or a fill position.

Figure 2A:
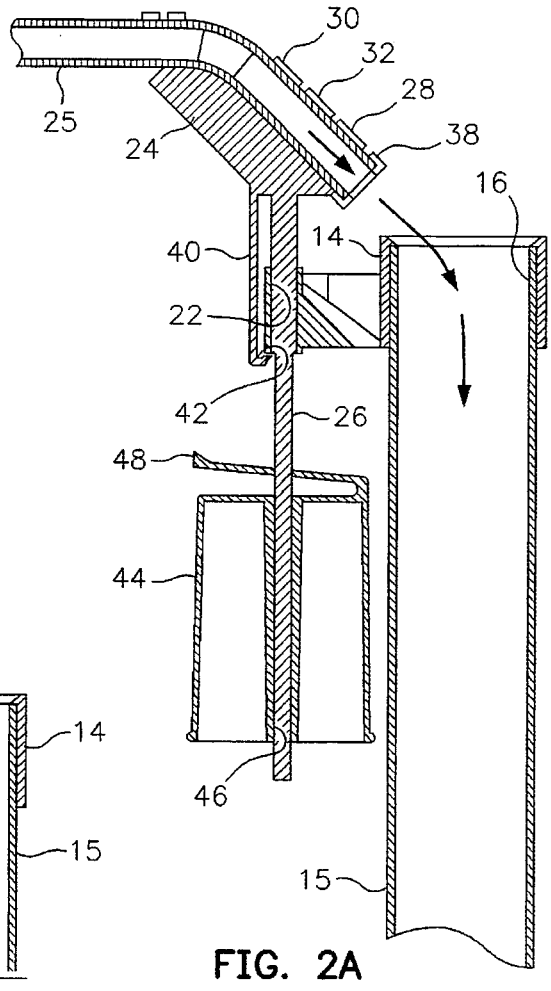
Figure 2B:
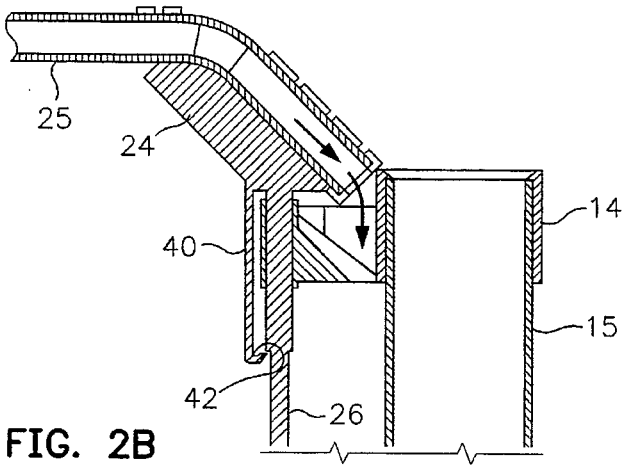

The apparatus of FIGS. 1, 2*a* and 2*b* operates by lowering the end of the refill tube to a position as shown in FIG. 2*b* when the water level drops, particularly for the long flush cycle, to a position to divert water flowing from the end of the refill tube into the flush tank as shown by the arrow. When the water level rises to a selected position (FIG. 2*a*) which is typically the low level for the short flush, the end of the refill tube is held or lifted upward to a position relative to bracket 12 so that the flow therefrom is directed into the upper end of the overflow tube (FIG. 2*a*). The upper position of the refill tube is reached when the shoulder 42 engages the lower edge of bracket 12.

The flow diverting apparatus will typically remain in the position shown in FIG. 2*a* for short flushes. The flush water for a short flush will not normally drop below the bottom of float 44 for short flushes. The float may be adjusted for the proper level.

The flow diverting apparatus will assume the position as shown in FIG. 2*b* for long flushes. A first predetermined portion of refill water will be diverted from the upper end of overflow tube 15. The float 44 will subsequently rise as shown in FIG. 2*a* during a final position of the refill cycle. The portion of refill water diverted can be selected by adjustment of the float 44 on the rod 26.

Figure 3:
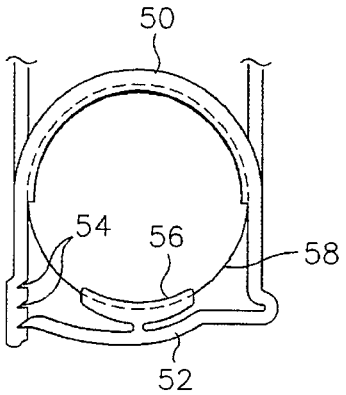
FIG. 3 is a top plan view of an adjustable mounting clamp.

Referring to FIG. 3 an alternate embodiment of the clamp portion of the mounting bracket is illustrated. This bracket 50 has a generally C-shaped configuration with a pivoting arm 52 hinged to one side of the C-shaped bracket and selectively engageable at the other side with selected ones of a plurality of notches 54. The notches enable the arm to selectively engage at a surface 56 with the surface of an overflow tube 58. This enables the bracket to be mounted on any number of different sizes of overflow tubes.

Figure 4:
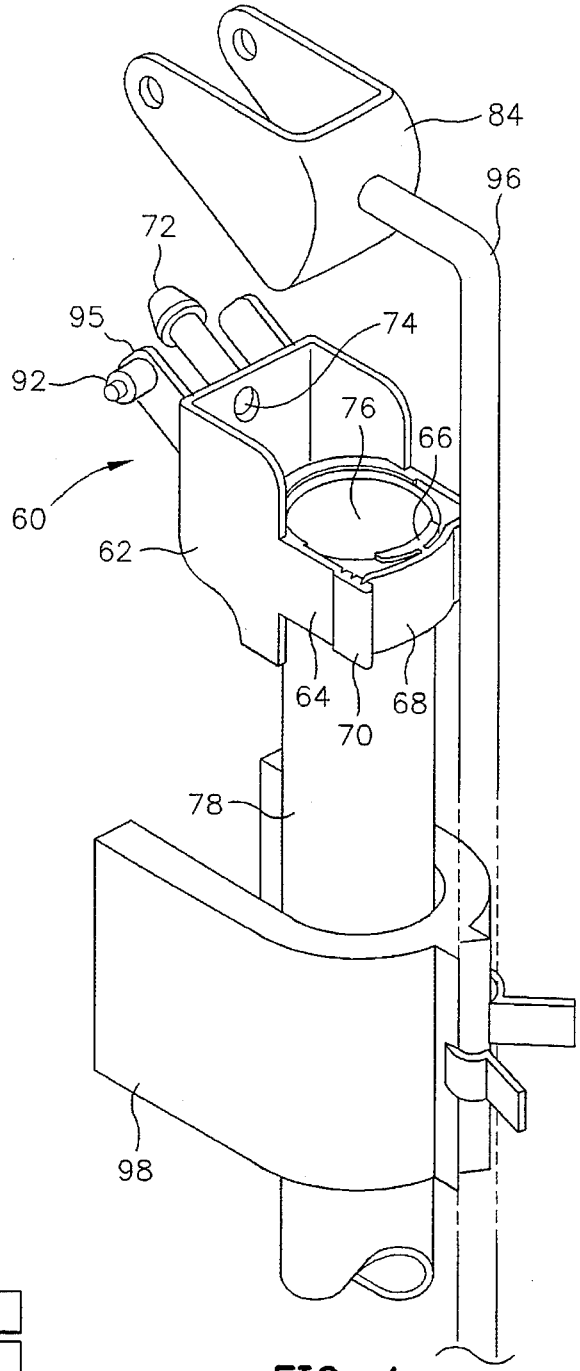
FIG. 4 is a perspective view of an alternate embodiment of the invention.

Referring to FIG. 4 of the drawings, an alternate embodiment of the invention is illustrated and designated generally by the numeral 60. The apparatus comprises a mounting bracket 62 having adjustable clamping means such as that of FIG. 3 comprising a pair of arms 64 and 66 with a pivoting arm 68 selectively engaging a notched latch member 70 at the outer end of arm 64. This bracket may adjustably mount on the upper end of a number of different sizes of overflow tubes. The bracket includes a hose nipple or tube 72 to which the end of a refill tube mounts for directing water through an opening 74 into the upper end 76 of an overflow tube 78.

Figure 5:
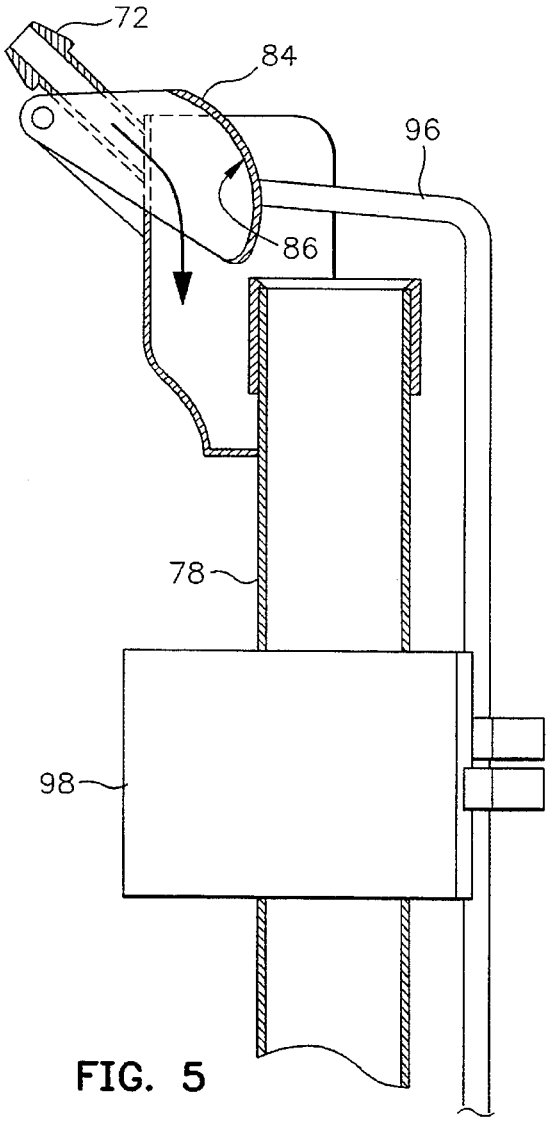
FIG. 5 is a side elevation view, partially in section, of the embodiment of FIG. 3 showing the refill diverter in the diverting position.
Figure 6:
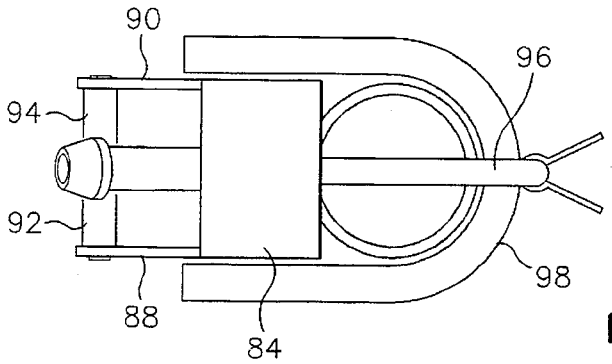
FIG. 6 is a top view of the embodiment of FIG. 5.

Diverting means for diverting flow of bowl refill water from the refill tube away from the overflow tube and into the flush tank comprises a bracket member 84 having a curved diverting surface 86 as seen in FIGS. 4 and 5. The diverting member includes a pair of arms 88 and 90 for pivotly mounting on pins 92 and 94 on a support arm 92 extending from bracket 62 below nipple 72. A generally L-shaped lever arm 96 is secured at an upper end to the diverting member 84 and extends downward generally parallel to the overflow tube 78 and includes a generally U-shaped float 98 adjustably secured thereto by suitable clamping or gripping members 100 and 102. The float 98 may be adjustably secured at selective positions along the arm 96 to respond to selected water levels.

The apparatus functions to divert refill water from the overflow tube as will be seen by the flow arrow in FIG. 5 during the start of a refill from a long flush. Thus, part of the bowl refill water will be diverted into the flush tank during the initial stage of tank refill until the water reaches a level such as shown in FIG. 7 wherein the float 98 rises and pivots the float diverting member 84 upward to a position as shown in FIG. 7 to enable the flow from the refill tube to enter the overflow tube as shown.

Figure 7:
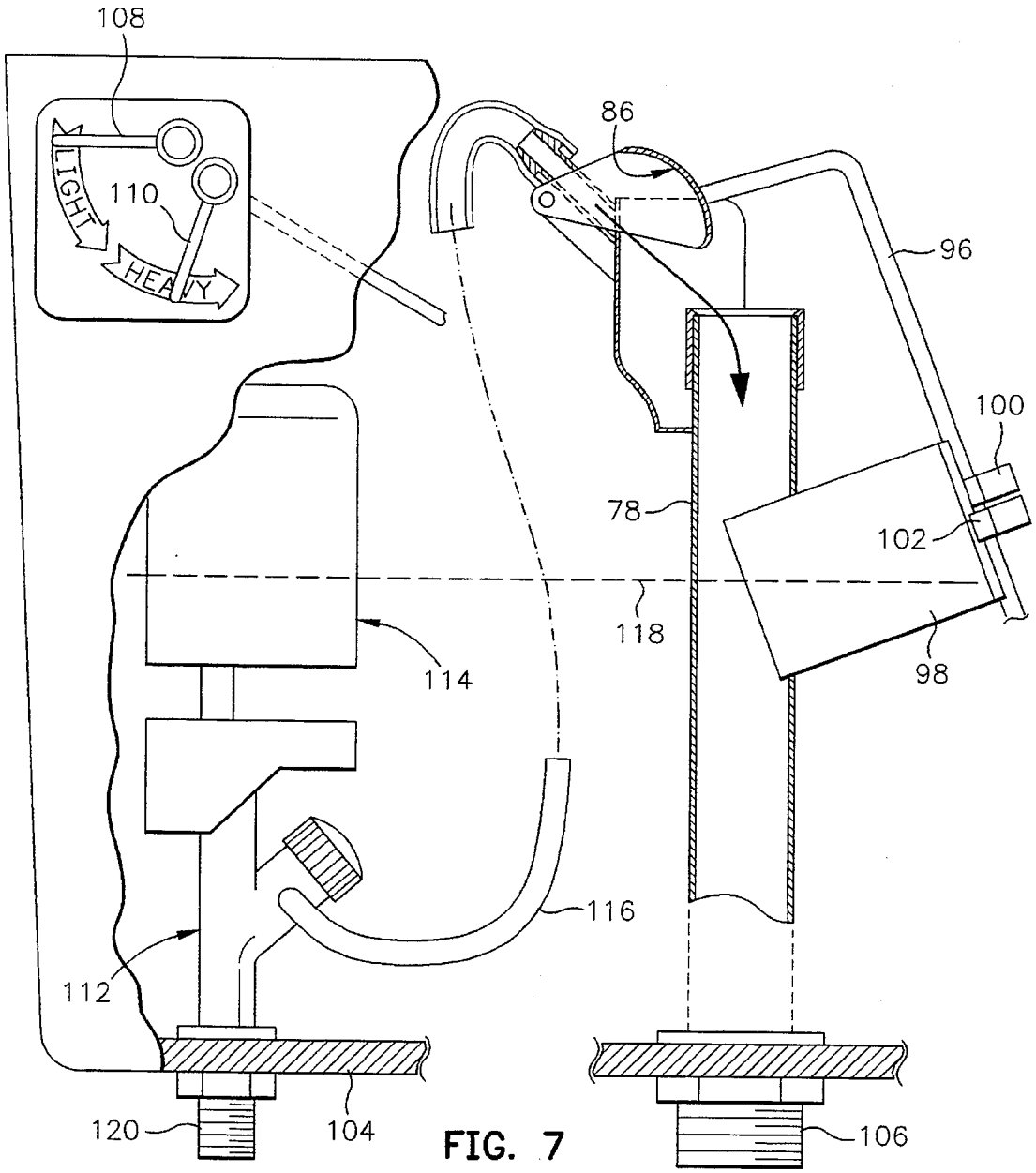
FIG. 7 is a side elevation view showing the refill apparatus in its environment with the diverter in the non-diverting position.

For ease of understanding the invention, it is illustrated in FIG. 7 in conjunction with typical components of a toilet flush and refill system. As illustrated in FIG. 7, a toilet flush tank 104 normally rests and is mounted on top of a toilet bowl. The bottom of the tank includes a connection 106 which typically connects to the bowl communicates water from the flush tank into the bowl for flushing purposes. The assembly typically includes the lower end of the overflow tube 78 and a flapper valve and seat not shown, which controls the release of water into the toilet below. Flushing of the toilet is accomplished by lifting the flapper valve or one of two flapper valves as in some prior art devices by means of a control lever such as 108 for a long flush, and 110 for example for a short flush. A full flush may, for example, release a full tank of water through the toilet bowl, whereas a short flush may release approximately half the tank of water for flushing.

When the flush is completed, the water level has dropped to a point such that a refill valve 112 is actuated by a float 114. The refill valve is connected to a source of pressurized water by a fitting or connector 120, directs approximately 80% of its water directly into the tank 104 and approximately 20% of its water goes through a refill tube 116 which, in the conventional system, is clipped to or mounted to direct the flow therefrom directly into the overflow tube 78 for refilling the toilet bowl and the p-trap.

In operation of the subject invention, for a long flush the water level 118 will drop to a position below that shown in FIG. 7, such that the float 98 will pivot the deflector 84 to the position as shown in FIG. 5. This results in deflecting the initial flow from the refill valve into the tank away from the overflow tube 78. As soon as the water level has reached a point such as 118 shown in FIG. 7, wherein float 98 raises and pivots the deflector 84 out of the flow path from the refill tube, the flow will be directed into the upper end of the overflow tube 78. This fills the toilet bowl and p-trap during the filling of the tank from the position such as shown in FIG. 7 to its full position. Thus, the refill apparatus operates to refill the toilet bowl and p-trap with the same amount of water after each flush, whether a long flush or a short flush.

Figure 8:
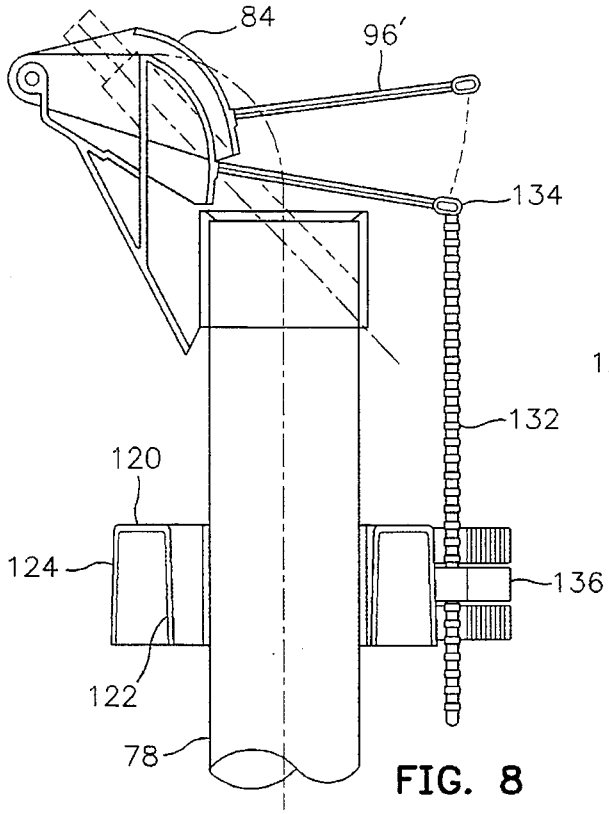
FIG. 8 is a view like FIG. 5 of a further embodiment.

Referring to FIG. 8, a modification of the FIG. 4 embodiment is illustrated wherein identical elements are identified by the same numeral. In this modification the float is an annular inverted cup 120 mounted on and surrounding the overflow tube 74. The float is formed of a suitable plastic and formed with inner and outer walls 122 and 124. The inner wall forms a bore through which the tube 74 extends.

A plurality of spacers or standoff ribs 126, 128 and 130 support the float on the tube 74 in an eccentric position to provide space to allow passage of the refill water when it is diverted from the overflow tube. The float is connected to the diverting bracket 84 by means of a link member 132 pivotally connected by a pin at 134 to lever 96. The float is adjustably connected to the link 132 by a clamp or gripping means 136.

Figure 9:
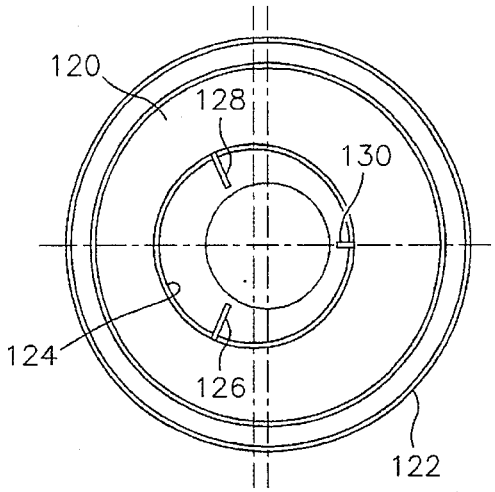
FIG. 9 is a top plan view of an alternate float.
Figure 10:
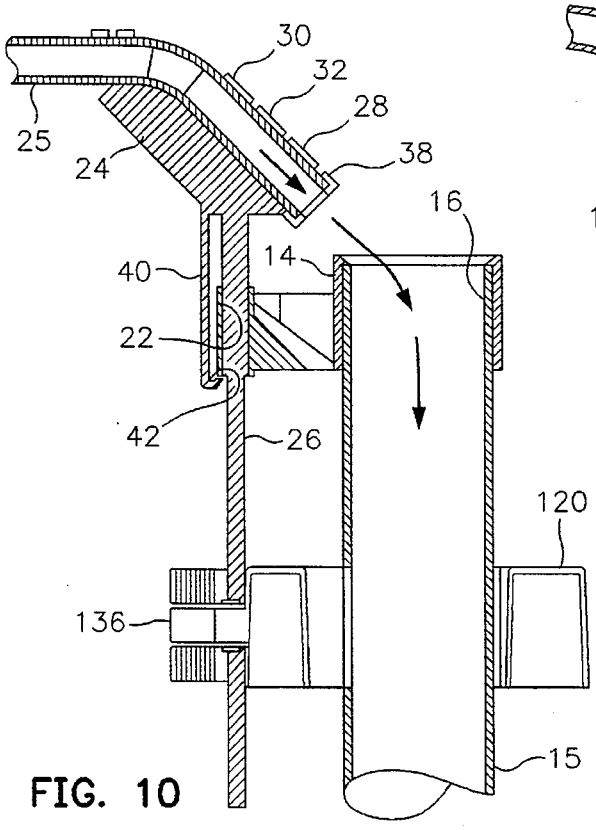
FIG. 10 is a view like FIG. 2*a* of another embodiment.

Referring to FIG. 10, the FIG. 1 embodiment is provided with the FIG. 9 float 120 attached by clamp 136 to rod 26. The float can be adjustably positioned vertically on rod 26 to adjust it for proper water levels.

Since the float 120 is mounted on and guided by the tube 15, the guide structure for the shaft 26 could be eliminated and the end of the refill hose or tube could be mounted directly on the float. This would eliminate possible binding sites. This circular form of float is confined to travel along the tube and can fit into smaller more confined spaces. It can also be adjusted in its travel to accommodate various tank and bowl capacities.

Figure 11:
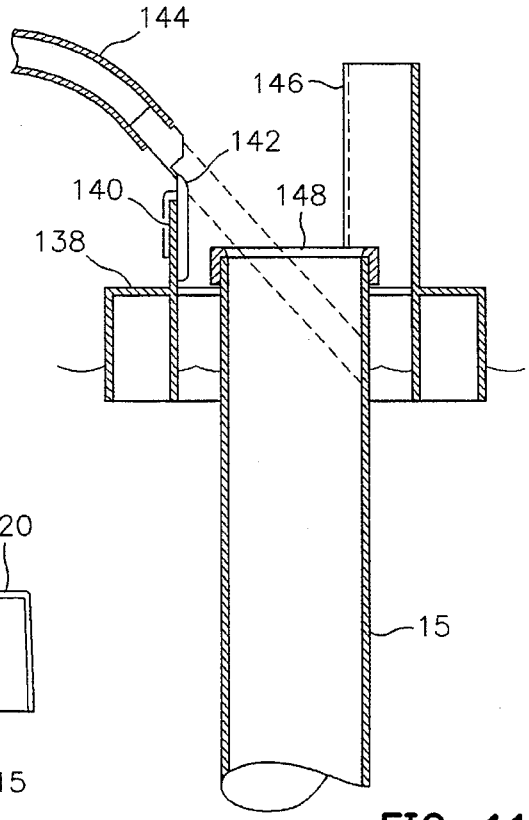
FIG. 11 is a view like FIG. 10 of a still further embodiment.

Referring to FIG. 11, a slightly modified version of a circular float 138 is provided with an upward extending finger 140. A hose clip 142 mounts or clips the end of refill tube or hose 144 to the finger 140. The end of refill tube 144 is thereby carried directly by the float. The arm or finger 140 must have a length sufficient to provide the requisite duration of diversion of the water. An upwardly extending splash guard 146 may be provided to direct water back into overflow tube at certain positions of the refill tube 144. A stop ring 148 may be secured on top of the tube 15 to retain the float on the tube.

While we have illustrated and described our invention by means of specific embodiments, it is to be understood that numerous changes and modifications may be made therein without departing from the spirit or scope of the invention, as defined in the appended claims.

We claim:

1. An apparatus for diverting a flow from a refill tube in a flush tank, comprising:

an annular float for mounting on an overflow tube for vertical reciprocable movement with water level in the flush tank, said annular float being formed with a central throughbore for receiving said overflow tube, and said float including a plurality of standoff ribs extending inward from an inner wall of said throughbore for engagement with said overflow tube;

means for mounting on an upper end of the overflow tube for limiting upward movement of said float; and attachment means on said float for directly connecting to and supporting the outlet end of the refill tube so that vertical movement of said float responsive to water level in the flush tank moves said outlet end of said refill tube vertically for diverting water from the outlet end of the overflow tube into the flush tank during a first portion of a refill cycle and moves said outlet end of said refill tube vertically for directing water into the upper end of the overflow tube during a second portion of a refill cycle.

2. An apparatus according to claim 1 wherein said means for mounting on an upper end of the overflow tube for limiting upward movement of said float comprises a stop ring.

3. An apparatus according to claim 2 wherein said float has an upper surface, and said upper surface engages said stop ring at the upper limit of movement of said float, and said attachment means positions the outlet end of the refill tube at said upper surface.

4. An apparatus according to claim 3 wherein said attachment means is on said float upper surface offset to one side of said throughbore, and said float includes a splash guard extending upward from said upper surface on a side opposite said one side.

5. An apparatus according to claim 1 wherein:

said means for mounting on an upper end of the overflow tube for limiting upward movement of said float comprises a bracket including a sleeve for receiving an upper end of the overflow tube for supporting said bracket on the overflow tube, an arm secured at an inner end to and extending outward from said sleeve and a guide bore in an outer end of said arm, said bore normally oriented vertically in use;

an elongated connecting rod reciprocally mounted for vertical movement in said guide bore;

said float directly connected to a lower end of said connecting rod; and said attachment means on an upper end of said connecting rod for connecting to and supporting the outlet end of the refill tube, and a clip member releasably latching said rod to said arm.

6. An apparatus according to claim 5 wherein said sleeve on said support means comprises an adjustable clamp for attachment to an upper end of the overflow tube.

7. An apparatus according to claim 6 wherein said float comprises an inverted annular cup having gripping means for receiving said connecting rod and selectively gripping said rod for selectively positioning said float along said rod.

8. An apparatus according to claim 1 wherein:

at least some of said ribs have different heights for eccentrically positioning said float relative to the overflow tube.

9. An apparatus for diverting a flow from a refill tube in a flush tank, comprising:

an annular float formed with a central throughbore for receiving and mounting on the overflow tube, said float moveable vertically on the overflow tube for supporting the refill tube, and said float including a plurality of standoff ribs extending inward from an inner wall of said throughbore for engagement with the overflow tube;

an arm extending upward from said float for receiving and mounting an outlet end of the refill tube; and a ring mounted on an upper end of the overflow tube for limiting the upward movement of said float.

10. An apparatus according to claim 9 wherein said float is an inverted annular cup and has an upper surface, said upper surface engages said stop ring at the upper limit of movement of said float, and said arm positions the outlet end of the refill tube at said upper surface.

11. An apparatus according to claim 10 wherein said arm is on said float upper surface offset to one side of said throughbore, and said float includes a splash guard extending upward from said upper surface on a side opposite said one side.

12. An apparatus according to claim 9 wherein said a plurality of standoff ribs extend inward from an inner wall of said throughbore different distances for eccentrically positioning said float in engagement with said overflow tube.

* * * * *